US006453143B2

(12) United States Patent
Takeuchi

(10) Patent No.: US 6,453,143 B2
(45) Date of Patent: Sep. 17, 2002

(54) ENDLESS BELT, METHOD FOR MANUFACTURING THE ENDLESS BELT, CONVEYING DEVICE, TUBULAR FILM, METHOD FOR MANUFACTURING THE TUBULAR FILM, AND IMAGE FORMING APPARATUS

(75) Inventor: Kazutaka Takeuchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/861,675

(22) Filed: May 22, 2001

(30) Foreign Application Priority Data

May 26, 2000 (JP) ..... 2000-156649

(51) Int. Cl.[7] ..... G03G 15/16

(52) U.S. Cl. ..... 399/303; 198/840; 399/302; 399/308; 399/313

(58) Field of Search ..... 399/297, 303, 399/313, 162, 164, 165, 308, 302; 198/806, 807, 813, 837, 840, 838, 842

(56) References Cited

U.S. PATENT DOCUMENTS 4,862,211 A * 8/1989 Kutami et al. ..... 399/165
4,899,872 A * 2/1990 Hokao ..... 198/840
5,017,969 A * 5/1991 Mitomi et al. ..... 198/840
5,149,941 A 9/1992 Hirabayashi et al. ..... 219/216
5,369,477 A * 11/1994 Foote et al. ..... 198/840
5,507,382 A * 4/1996 Hartwell et al. ..... 198/806
5,968,300 A * 10/1999 Shimura et al. ..... 198/840
6,101,362 A * 8/2000 Shimura et al.
6,160,978 A * 12/2000 Tsuruoka et al. ..... 399/165

FOREIGN PATENT DOCUMENTS

| | | |
|---|---|---|
| JP | 54-69442 | 6/1979 |
| JP | 63-313182 | 12/1988 |
| JP | 1-160277 | 6/1989 |
| JP | 4-159911 | 6/1992 |
| JP | 10-221967 | * 8/1998 |
| JP | 10-268660 | * 10/1998 |

* cited by examiner

*Primary Examiner*—Susan S. Y. Lee
(74) *Attorney, Agent, or Firm*—Fitzpatrick, Cella, Harper & Scinto

(57) ABSTRACT

In a transfer belt, serving as the endless belt, a groove is formed so as to set a side surface of the rib member at a position separated by a distance A from a lateral-direction end of the transfer belt. The distance A is longer than a distance X between a first end and a second end of the rib member.

41 Claims, 10 Drawing Sheets

ENDLESS BELT, METHOD FOR MANUFACTURING THE ENDLESS BELT, CONVEYING DEVICE, TUBULAR FILM, METHOD FOR MANUFACTURING THE TUBULAR FILM, AND IMAGE FORMING APPARATUS

BACKGROUND OF THE INVENTION

1. Field of the Invention

The present invention relates to a conveying belt used for conveying a precision component to a predetermined position while guaranteeing very precise position accuracy, an annular, tubular, ring-shaped or belt-shaped film, such as a closed envelope for packing or accommodating an article, and a method for manufacturing the film. The present invention is mainly utilized for a functional component of an image forming apparatus. Particularly, the present invention relates to a endless belt, a method for manufacturing the endless belt, a conveying device, a tubular film, a method for manufacturing the tubular film, and an image forming apparatus.

2. Description of the Related Art

In conventional electrophotographic image forming apparatuses, an optical-information electrostatic latent image is formed on the surface of a photosensitive member by causing the photosensitive member to perform running (rotation/movement) in one direction at a constant speed and exposing optical information on the surface of the photosensitive member. Although a rotating cylindrical drum is usually used as the photosensitive member, a running endless belt is also used.

In some electrophotographic image forming apparatuses, when forming a color latent image, endless-belt conveying devices are used as a transfer-material conveying member, an intermediate transfer member, a continuous sheet conveying member and the like for mixing four-color, i.e., Y (yellow), C (cyan), M (magenta) and K (black), latent images on a recording medium.

Conventionally, a heat-roller fixing method in which a recording medium is grasped and conveyed between a heat roller and a pressing roller is used as a fixing method for fixing/solidifying a toner latent image on the recording medium has been widely used. A fixing device using a thin-film endless belt in order to shorten the warm-up time is disclosed in Japanese Patent Application Laid-Open (Kokai) No. 63-313182 (1988).

Recently, the number of image forming apparatuses using endless belts in the above-described manner is increasing. When using cylindrical drums as the above-described components, no problem arises by rotatably driving each drum around the central axis thereof. However, when running an endless belt, the problem of skew of the endless belt stretched between rollers with respect to the driving direction arises. If the skew is not corrected, a desired image cannot be formed (in formation of a latent image, image transfer, and image fixing), and problems, such as disturbance of the formed image, and the like, may arise.

There are two main approaches for preventing skew of an endless belt.

(1) In one approach, deviation or skew of an endless belt is detected by some means, and the endless belt is forcedly returned to its original running position by the tension or the centripetal force of the belt. Japanese Patent Application Laid-Open (Kokai) No. 54-69442 (1979) discloses, for example, a method of inclining a roller for driving the belt, a driven roller for stretching the belt, and the like, so as to move in a direction opposite to the moving direction of the belt. The application also discloses a method of stretching the belt between a driving roller and a driven roller, providing a swingable swinging roller contacting the inner surface of the belt at a substantially midpoint of the belt, and swinging the swinging roller in a certain direction in accordance with signals from detection means for detecting deviation of the belt which are disposed at both side portions of the belt.

However, in the above-described methods, it is necessary to use detection means, and to provide a mechanical device for inclining the roller, and extra members, such as a vibration roller and the like, which are substantially unnecessary in an image forming apparatus, resulting in an expensive configuration.

(2) In another approach, in order to inexpensively prevent skew of an endless belt, at least one rubber-band-shaped endless rib member or line-shaped rib member having end portions is mounted at one end portion or both end portions of the surface or the back of the endless belt, and skew of the endless belt is regulated by causing the rib member to contact a guide member provided at a part of each of driving and driven rollers. Methods for mounting rib members on the inner surface of an endless belt have been proposed, for example, in Japanese Patent Application Laid-Open (Kokai) No. 4-159911 (1992), and methods for mounting rib members on the outer sides of an endless belt have been proposed, for example, in Japanese Patent Application Laid-Open (Kokai) No. 1-160277 (1989).

However, in the above-described approach (2) in which skew of an endless belt is controlled by mounting rib members made of rubber or the like at at least one end portion of the endless belt, and regulating the rib members by guide members, since problems, such as deviation in color, and the like, during color-image formation (to be described later) arise, it has recently become necessary to very precisely mount ribs. As a result, very precise accuracy in the shape of rib members, such as straightness, linearity and the like, has been requested. Accordingly, the frequency of use of line-shaped rib members whose shape can be very precisely controlled compared with the case of using a rib member having the shape of an endless rubber band is increasing.

No particular problem arises when using an endless rib member. However, when using a line-shaped rib member, a small gap is formed at a connection portion formed by both ends of the rib member. If an endless belt is driven while being stretched between rollers in this sate, a stress generated by discontinuity of the rib member is applied to a belt portion positioned at the gap of the rib member every time the gap passes through the roller portions, resulting in repeated application of load at that belt portion more than at other portions. As a result, the belt tends to destruct or break at the connection portion.

In order to prevent such problems, approaches of dispersing concentration of the stress, for example, by obliquely cutting the end surface of the rib member at the connection portion, or making the end surfaces of the rib in the shape of a hook have been devised. However, many problems are present, for example, in the provision of a device for cutting the end surfaces of the rib obliquely or in the shape of a hook, and accuracy in bonding at the connection portion.

SUMMARY OF THE INVENTION

It is an object of the present invention to provide an endless belt, a method for manufacturing the endless belt, a conveying device, a tubular film, a method for manufacturing the tubular film, and an image forming apparatus, in which high durability is obtained by suppressing skew of each of the above-described components.

According to one aspect, the present invention which achieves the above-described object relates to an endless belt including at least one rib member, whose both end surfaces face each other, provided on an inner circumferential surface of the endless belt. The endless belt is stretched between at least two rollers and driven while contacting the at least one rib member to side surfaces of the at least two rollers. A first distance from a lateral-direction end, serving as an end of the endless belt in a lateral direction, which is closer to a side where the at least one rib member is provided, to a side surface of the at least one rib member at a side closer to the lateral-direction end is longer than a second distance, serving as an interval of a gap portion formed by the facing end surfaces of the at least one rib member.

In the endless belt according to the present invention configured in the above-described manner, since the rib member is formed at a position where concentration of stress generated in the endless belt at the gap portion of the rib member does not influence the lateral-direction end of the endless belt, breakage of the endless belt from the lateral-direction end near the gap portion due to concentration of the stress generated in the endless belt at the gap portion can be suppressed for a long time.

Preferably, the first distance is longer than the second distance by at least twice. A cross-section of the at least one rib member may be a rectangle, and a hardness of the at least one rib member may be smaller than a hardness of the endless belt.

According to another aspect, the present invention which achieves the above-described object relates to a method for manufacturing an endless belt including at least one rib member, whose both end surfaces face each other, provided on an inner circumferential surface of the endless belt. The endless belt is stretched between at least two rollers and driven while contacting the at least one rib member to side surfaces of the at least two rollers. The method includes the step of forming a groove for mounting the at least one rib member at a position where a first distance from a lateral-direction end, serving as an end of the endless belt in a lateral direction, to a side surface of the at least one rib member at a side closer to the lateral-direction end is longer than a second distance, serving as an interval of a gap portion formed by the facing end surfaces of the at least one rib member.

In the above-described method for manufacturing the endless belt according to the present invention, the groove for mounting the rib member is formed at a position where concentration of stress generated in the endless belt at the gap portion of the rib member does not influence the lateral-direction end of the endless belt. Hence, in the endless belt manufactured in the above-described method, breakage of the endless belt from the lateral-direction end near the gap portion due to concentration of the stress generated in the endless belt at the gap portion is prevented for a long time.

The method for manufacturing the endless belt according to the present invention preferably includes the step of forming the first distance so as to be longer than the second distance by at least twice. The method may include the step of forming a cross-section of the at least one rib member to be a rectangle, and may include the step of forming the at least one rib member with a material whose hardness is smaller than a hardness of the endless belt.

According to still another aspect, the present invention which achieves the above-described object relates to a conveying device including a conveying belt stretched between at least two rollers, and driving means for driving at least one of the rollers. The conveying device conveys a sheet material mounted on the conveying belt. The conveying belt is one of the above-described endless belts.

In the conveying device according to the present invention configured in the above-described manner, since the endless belt according to the present invention is used as the conveying belt, breakage of the conveying belt from the lateral-direction end near the gap portion due to concentration of the stress generated in the conveying belt at the gap portion is prevented for a long time.

According to yet another aspect, the present invention which achieves the above-described object relates to a tubular film including at least one rib member, whose both end surfaces face each other, provided on an inner circumferential surface of the tubular film, and rotatably driven while contacting the at least one rib member to an external regulating member. A first distance from a lateral-direction end, serving as an end of the tubular film in a lateral direction, which is closer to a side where the at least one rib member is provided, to a side surface of the at least one rib member at a side closer to the lateral-direction end is longer than a second distance, serving as an interval of a gap portion formed by the facing end surfaces of the rib at least one member.

In the tubular film according to the present invention configured in the above-described manner, since the rib member is formed at a position where concentration of a stress generated in the tubular film at the gap portion of the rib member does not influence the lateral-direction end of the tubular film, breakage of the tubular film from the lateral-direction end near the gap portion due to concentration of the stress generated in the tubular film at the gap portion can be suppressed for a long time.

Preferably, the first distance is longer than the second distance by at least twice. A cross-section of the at least one rib member may be a rectangle, and a hardness of the at least one rib member may be smaller than a hardness of the endless belt.

According to yet a further aspect, the present invention which achieves the above-described object relates to a method for manufacturing a tubular film including at least one rib member, whose both end surfaces face each other, provided on an inner circumferential surface of the tubular film, and rotatably driven while contacting the at least one rib member to an external regulating member. The method includes the step of forming a groove for mounting the at least one rib member at a position where a first distance from a lateral-direction end, serving as an end of the tubular film in a lateral direction, which is closer to a side where the at least one rib member is provided, to a side surface of the rib member at a side closer to the lateral-direction end is longer than a second distance, serving as an interval of a gap portion formed by the facing end surfaces of the at least one rib member.

The method for manufacturing the tubular film according to the present invention preferably includes the step of forming the first distance so as to be longer than the second distance by at least twice. The method may include the step of forming a cross-section of the at least one rib member to be a rectangle, and may include the step of forming the at least one rib member with a material whose hardness is smaller than a hardness of the endless belt.

According to still another aspect, the present invention which achieves the above-described object relates to an electrophotographic image forming apparatus including a conveying belt, and a fixing device. A latent image is formed on a surface of a charged photosensitive drum by scanning the surface with a laser beam, a toner is caused to adhere to the latent image, the toner is then transferred onto a recording material on the conveying belt, and the toner is fixed by the fixing device. The conveying belt is one of the above-described endless belts.

In the image forming apparatus according to the present invention configured in the above-described manner, since the endless belt according to the present invention is used as the conveying belt, breakage of the conveying belt from the lateral-direction end near the gap portion due to concentration of the stress generated in the conveying belt at the gap portion is prevented for a long time.

The image forming apparatus according to the present invention may further include an intermediate belt for performing, after primary transfer of the toner adhering to the photosensitive drum, secondary transfer of the toner subjected to the primary transfer, onto the recording material. The intermediate belt may be one of the above-described endless belts. The fixing device may include a pressing roller and one of the above-described tubular films.

The foregoing and other objects, advantages and features of the present invention will become more apparent from the following description of the preferred embodiments taken in conjunction with the accompanying drawings.

DESCRIPTION OF THE PREFERRED EMBODIMENTS

In an endless belt including at least one rib member, whose both end surfaces face each other, provided on an inner circumferential surface of the endless belt, which is stretched between at least two rollers and driven while contacting the at least one rib member to side surfaces of the at least two rollers, a first distance from a lateral-direction end, serving as an end of the endless belt in a lateral direction, which is closer to a side where the at least one rib member is provided, to a side surface of the at least one rib member at a side closer to the lateral-direction end is preferably equal to or less than 10 mm. That is, since the first distance represents a useless space in image formation, a smaller value is more preferable for the first distance in the configuration of the apparatus.

A second distance, serving as an interval of a gap portion formed between the end surfaces of the rib member, is preferably 1–5 mm. Stress concentrates on a portion of the endless belt where the end surfaces of the rib member face at the position of a roller. The magnitude of the stress is larger as the gap is smaller. Since a large stress may cause a crack in that portion of the endless belt, the second distance is preferably at least 1 mm. In order to set the first distance to a preferable value equal to or less than 10 mm, the second distance is preferably equal to or less than 5 mm.

Preferred embodiments of the present invention will now be described with reference to the drawings.

(First Embodiment)

Figure 1:
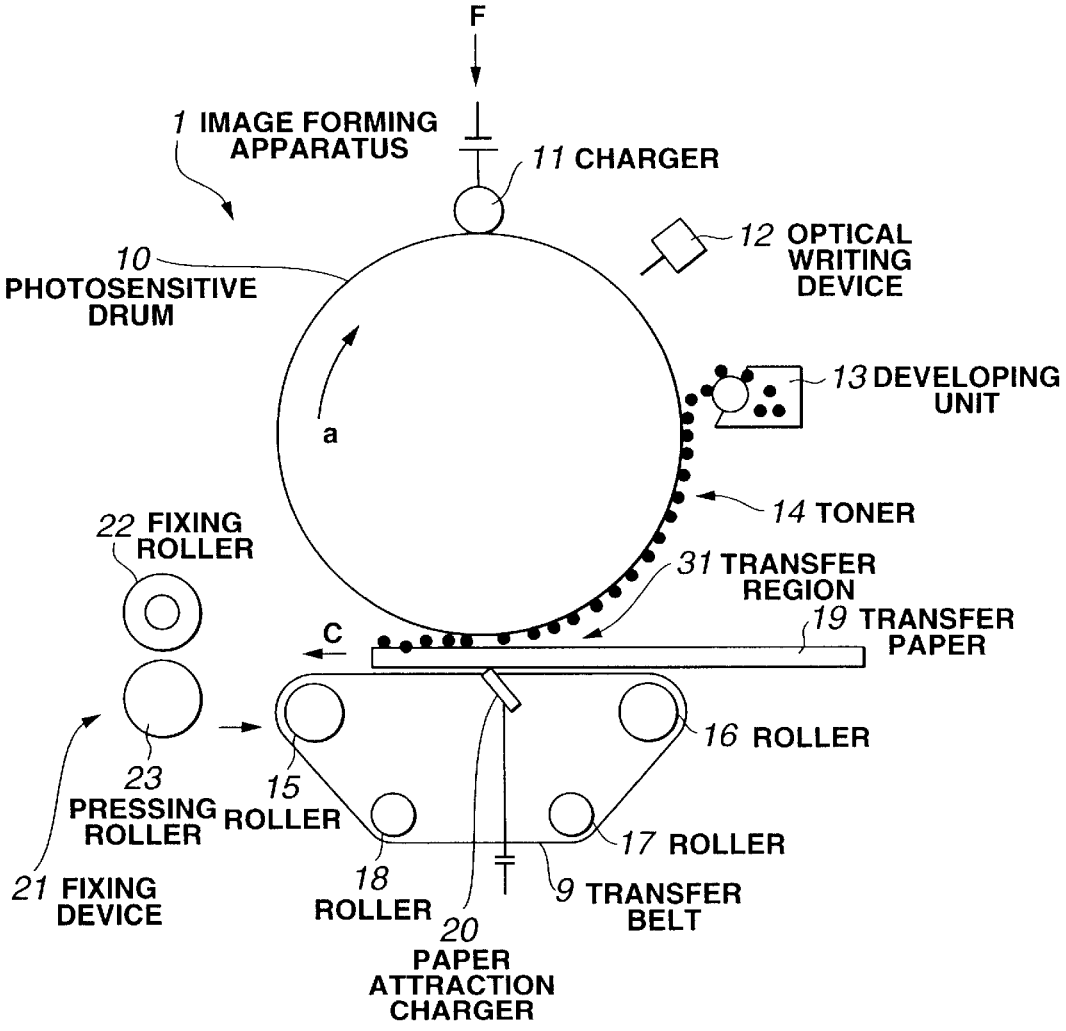
FIG. 1 is a schematic diagram illustrating an image forming apparatus according to a first embodiment of the present invention.

FIG. 1 is a schematic diagram illustrating an image forming apparatus according to a first embodiment of the present invention.

Figure 2:
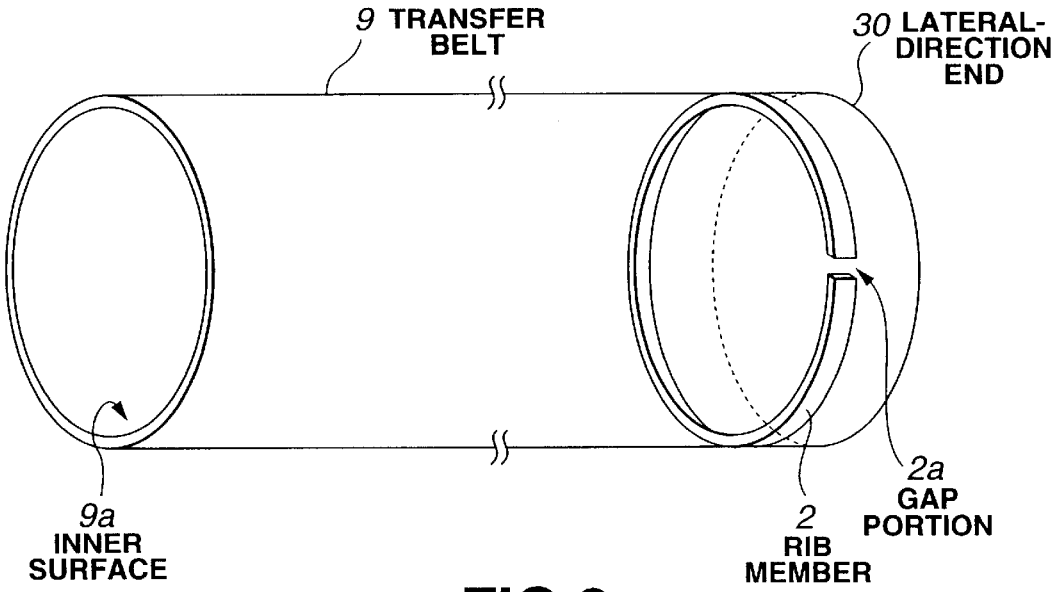
FIG. 2 is a see-through perspective view illustrating a transfer belt according to the first embodiment.
Figure 3:
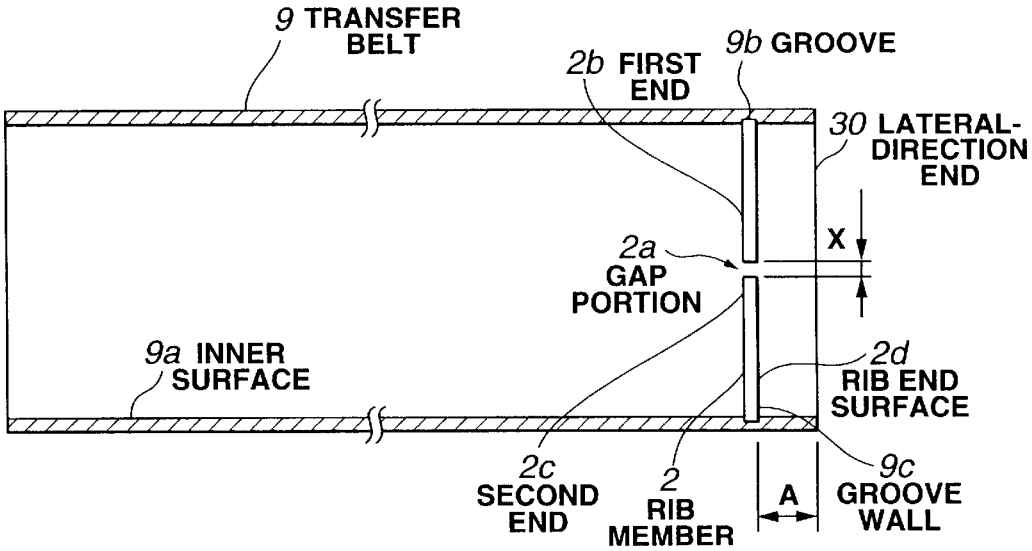
FIG. 3 is a longitudinal cross-sectional view of the transfer belt shown in FIG. 2.

FIG. 2 is a see-through perspective view illustrating an endless belt according to the first embodiment. FIG. 3 is a longitudinal cross-sectional view of the endless belt shown in FIG. 2. In FIG. 2, a rib member 2 is provided on an inner surface 9*a* of a transfer belt 9, serving as a closed-loop endless belt. In order to facilitate understanding, the rib member 2 is indicated by solid lines, and a groove 9*b* (see FIG. 3) where the rib member 2 is bonded and fixed is omitted. In FIG. 3, only the transfer belt 9 is depicted as a longitudinal cross section.

An image forming apparatus 1 includes a photosensitive drum 10, a charger 11 for charging the surface of the photosensitive drum 10, an optical writing device 12, serving as an exposure device for forming an electrostatic latent image on the photosensitive drum 10, a developing unit 13 containing a toner 14 to be supplied to the surface of the photosensitive drum 10, a transfer belt 9, stretched around rollers 15, 16, 17 and 18, for conveying transfer paper 19 on which an image is to be formed, a paper attraction charger 20 for attracting the transfer paper 19, serving as a sheet material, onto the transfer belt 9, a transfer charger for transferring the toner 14 onto the transfer paper 19, and a fixing device 21 which includes a fixing film 22 for fixing the toner 14 transferred to the transfer paper 19.

As shown in FIG. 3, the groove 9*b* is formed along the circumferential direction in the inner surface 9*a* of the transfer belt 9 at a position separated by a distance A from a lateral-direction end 30. The rib member 2 is bonded and fixed in the groove 9*b*. That is, the distance A is the distance from a rib side surface 2*d*, serving as a side surface of the rib member 2 at the side of lateral-direction end 30 of the transfer belt 9, i.e., a groove wall 9*c* of the groove 9*b* at the side of the lateral-direction end 30, to the lateral-direction end 30 of the transfer belt 9. The rib member 2 is not ring-shaped, but has a rectangular cross section. The rib member 2 is obtained by bonding and fixing an elastic member in the groove 9*b*, and has substantially the same length as the circumferential length of the groove 9*b* of the transfer belt 9. However, since the length of the rib member 2 is slightly shorter than the circumferential length of the transfer belt 9, a gap portion 2*a* having an interval of X is formed between a first end 2*b* and a second end 2*c* of the rib member 2 in the state in which the rib member 2 is bonded and fixed in the groove 9*b*. The distance A is such that the transfer belt 9 is not broken before a desired lifetime by application of concentration of stress at the gap portion 2*a* of the transfer belt 9 generated by using the rib member 2 in which the gap portion 2*a* having the interval X is formed, on the lateral-direction end 30 of the transfer belt 9. The distance A may be longer than the distance X.

Figure 4:
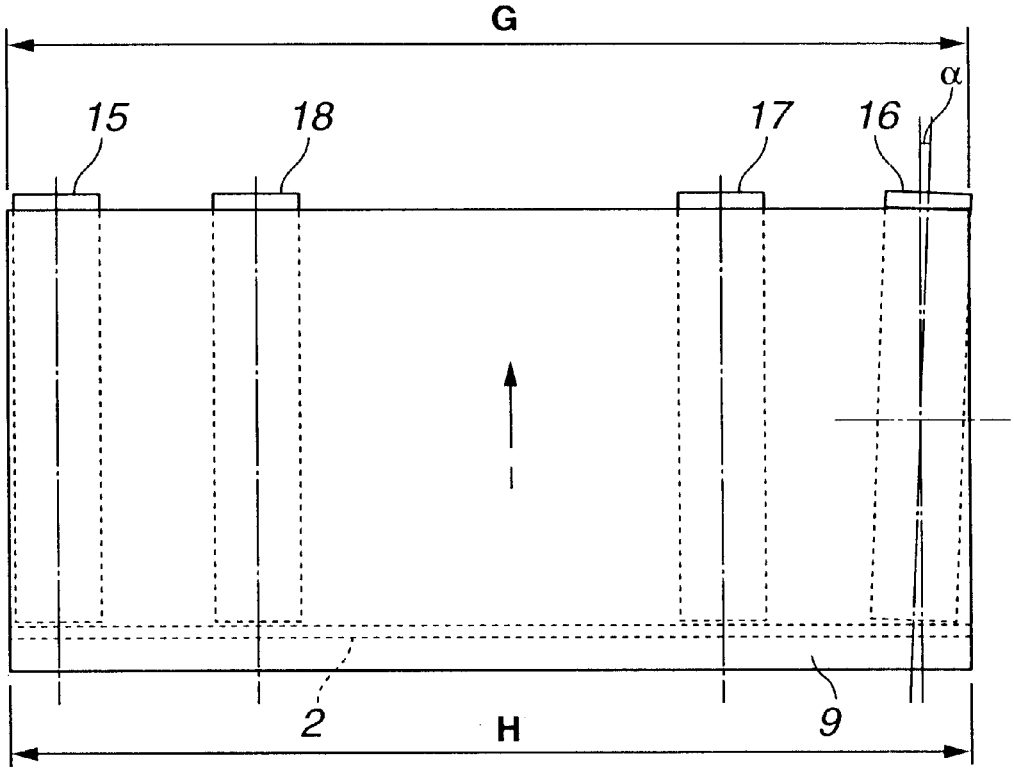
FIG. 4 is a see-through plan view illustrating a transfer belt portion shown in FIG. 1.

FIG. 4 is a see-through plan view of the transfer belt 9 stretched around the rollers 15, 16, 17 and 18, as seen from the direction of an arrow F shown in FIG. 1. In FIG. 4, the charger 11, the photosensitive drum 10 and the transfer paper 19 are omitted. Although the rollers 15, 17 and 18 are disposed in parallel to respective axes, the roller 16 is disposed by being inclined by an angle a with respect to the axes of the rollers 15, 17 and 18. By thus disposing the roller 16 in an inclined state, the length G of the transfer belt 9 at the upper side in FIG. 4 becomes longer than the length H at the lower side, so that the speed of the transfer belt 9 at the side G is higher than the speed at the side H, and the transfer belt 9 is moved toward the direction of an arrow I. The rib member 2 thereby contacts, i.e., is caught by, the side surfaces of the rollers 15, 17 and 18 so that skew of the transfer belt 9 is suppressed. The roller disposed in an inclined state is not limited to the roller 19, but any other roller may be disposed in an inclined state.

The transfer belt 9 stretched around the rollers 15, 16, 17 and 18 is rotatably driven in the direction of an arrow b at a constant speed Vf.

The function of each of the above-described components and an outline of image formation by the image forming apparatus 1 will now be described.

The photosensitive drum 10 is rotatably driven in the direction of an arrow "a" at a constant speed Vf by driving means (not shown). First, the surface of the photosensitive drum 10 is uniformly charged by the charger 11. Then, an electrostatic latent image is formed by the optical writing device 12 using a laser beam. The optical writing device 12 may also use a reflected light beam. The toner 14 is accommodated within the developing unit 13. The toner 14 which has been charged adheres to the electrostatic latent image formed by the optical writing device 12, to provide a visible toner image.

The transfer paper 19 is fed onto the transfer belt 9, is then attracted onto the transfer belt 9 by the sheet attraction charger 20, and is conveyed in the direction of an arrow C. At that time, the transfer paper 19 is conveyed at the same speed Vf as that of the transfer belt 9. When the transfer paper 19 has reached a transfer region 31, the toner image on the photosensitive drum 10 is transferred onto the transfer paper 19 by the paper attraction charger 20. After the image transfer, the transfer paper 19 is conveyed to the fixing device 21. In the fixing device 21, the fixing roller 22, serving as a heating rotating member, is slidably conveyed in tight contact with a heater (not shown) by a pressing roller 23, serving as a pressing rotating member. The transfer paper 19 bearing the unfixed toner image is grasped and conveyed together with the fixing roller 22 at a fixing nip portion configured between the fixing roller 22 and the pressing roller 23, and the unfixed toner image is fixed on the surface of the transfer paper 19 as a permanent image by means of heat from the heater provided via the fixing roller 22 and the pressing force at the fixing nip portion. Upon completion of fixing of the toner image by the fixing device 22, the transfer paper 19 is discharged to the outside of the apparatus.

The detailed process of bonding the line-shaped rib member 2 onto the transfer belt 9 will now be described with reference to FIGS. 5A–5C. Before the following bonding process, the groove 9*b* has already been formed so that the groove wall 9*c* is present at the position of the distance A from the lateral-direction end surface 30 toward the inner side of the transfer belt 9, and the rib member 2 has been formed so as to have a rectangular cross section.

Figure 5A:
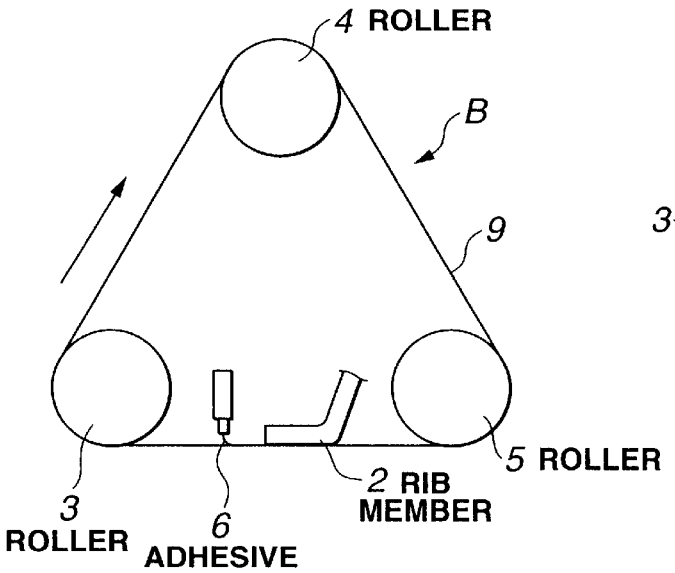
FIGS. 5A–5C are diagrams illustrating a process for bonding a rib member to the transfer belt according to the first embodiment.

First, the transfer belt 9 is stretched around three rollers 3, 4 and 5 as shown in FIG. 5A. The roller 3 is a driving roller, and can rotatably move the transfer belt 9 at a speed of 10 mm/sec. However, the rotational speed of the roller 3 is not limited to 10 mm/sec. Concave grooves 3', 4' are formed at one side portions of the rollers 3, 4 and 5, respectively. The position and the shape of the grooves 3', 4' and 5' can be arbitrary set in accordance with the shape of a transfer belt to be formed.

Figure 5B:
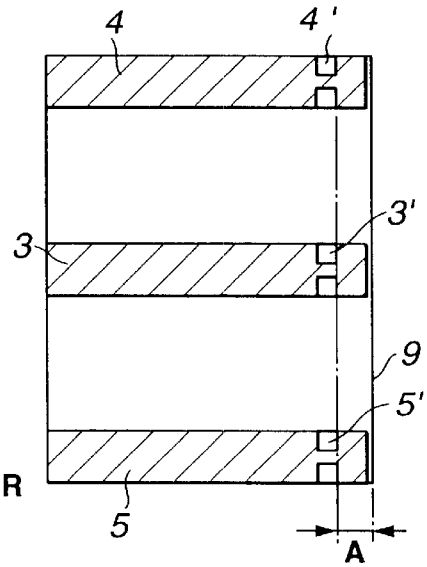
Figure 5C:
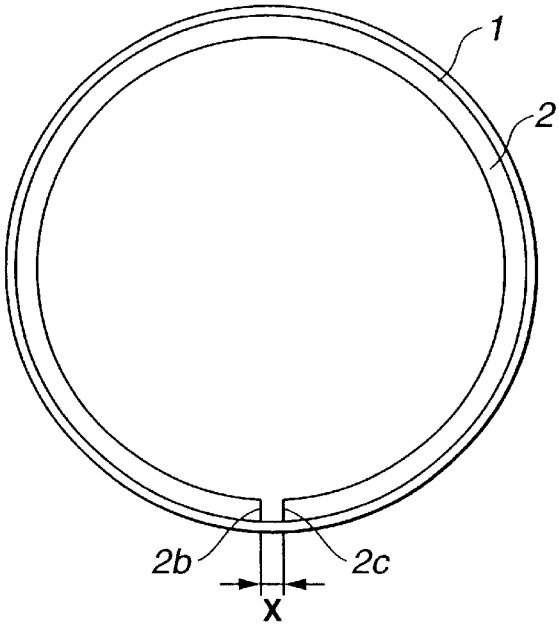

Next, as shown in FIG. 5B which is a diagram obtained by seeing FIG. 5A from direction B, the rib member 2 having a rectangular cross section over the entire length and formed with desired processing accuracy both in the longer side and the shorter side of the rectangular cross section is mounted so as to adjust the outer surface of the rib member 2 to the distance A from the end surface of the transfer belt 9. Substantially immediately before mounting the rib member 2, an epoxy-type adhesive 6 is coated on the groove 9*b* of the transfer belt 9 (see FIG. 5A). The processing accuracy of the rib member 2 in the directions of the longer side and the shorter side may be equal to or less than ±0.1 mm. The positional accuracy when mounting the rib member 2 may be set to ±0.1 mm over the entire circumference, and the distance A may be 2.0 mm.

After executing the process of coating the adhesive 6 on the groove 9*b* and mounting the rib member 2 over the entire circumference of the transfer belt 9, an extra portion of the rib member 2 is cut. The cross section of the cutting is substantially orthogonal with respect to the longitudinal direction of the rib member 2. An interval X between a first end 2*b*, serving as an end to start mounting of the rib member 2, and a second end, serving as an end to terminate mounting, may be 1.5 mm. The adhesive 6 may be a room temperature setting adhesive. Use of a heat setting adhesive, an ultraviolet-ray setting adhesive or the like is more preferable for shortening the processing time.

Next, a sheet-like film material which can be applied to the first embodiment will be described.

Any appropriate material, such as a non-thermoplastic resin, a thermosetting resin, a thermoplastic resin, a metal material, or an inorganic material, may be suitably used for the transfer belt 9 of the first embodiment. Particularly when using a resin, each type of resin material, such as each type of non-thermoplastic resin, heat setting polyimide, polyethylene, polypropylene, polymethyl pentene-1, polystyrene, polyamide, polycarbonate, polysulfone, polyallylate, polyethylene terephthalate, polybutylene terephthalate, polyphenylene sulfide, polyether sulfone, polyether nitrile, a thermoplastic polyimide-type material, polyether etherketone, a thermotropic liquid crystal polymer, polyamide acid, each type of fluororesin, or the like, or a blend resin of the above-described materials, or a thermoplastic elastomer formed by the blend is more suitably used.

A film obtained by mixing at least one of organic fine powder and inorganic fine powder in one of the above-described resin materials in order to provide a heat resisting property, a conductive property, a heat conductive property or the like, a film subjected to reinforcement by drawing with an appropriate draw ratio, or like may also be used.

For example, condensation-type polyimide powder may be used as the organic fine powder. Inorganic spherical fine powder, such as carbon black powder, magnesium oxide powder, magnesium fluoride powder, silicon oxide powder, aluminum oxide powder, boron nitride powder, aluminum nitride powder, titanium oxide powder or the like, fiber-shaped powder, such as carbon fibers, glass fibers or the like, whisker-shaped powder, such as potassium titanate powder, silicon carbide powder, silicon nitride powder or the like, may be used as the inorganic fine powder. The above-described fine powders may have various shapes and sizes.

The amount of mixture of the fine powder is preferably 5–70 weight % with respect to the base resin.

For example, a rubber, such as styrene butadiene rubber, nitrile rubber, chloroprene rubber, ethylene propylene terpolymer, butyl rubber, isoprene rubber, silicone rubber or the like, or a styrene type, olefine type, polyvinyl chloride type, urethane type, polyester type, polyamide type, fluorine type, chlorinated polyethylene type thermoplastic elastomer is preferable as the material for the rib member 2 of the first embodiment.

For example, a rubber type adhesive, such as neoprene, chloroprene or the like, or a melamine resin type, phenol resin type, epoxy type, vinyl acetate type, ethylene vinyl acetate type, cyanoacrylate type, or polyurethane type adhesive is preferable as the adhesive.

The hardness of the rib member 2 is preferably smaller than the hardness of the transfer belt 9.

The transfer belt mounting the rib for preventing skew at one end of the endless belt which is manufactured according to the above-described process is used as the transfer belt 9. At least one of the rollers 15, 16, 17 and 18 around which the transfer belt 9 s stretched is inclined, and the rib member 2 of the transfer belt 9 is set so as to always contact the end surfaces of the rollers 15, 16, 17 and 18.

By thus causing the rib member 2 to always contact the end surfaces of the rollers 15, 16, 17 and 18, skew of the transfer belt 9 while being rotatably driven is suppressed, so that the positional accuracy of the transfer belt 9 is improved and a high-precision image can be obtained.

In the transfer belt 9 of the first embodiment, since the rib member 9 is mounted in a state of being separated from the lateral-direction end 30 by the distance A which is lager than the distance X of the gap portion, concentration of the stress of the gap portion 2*a* of the rib member 2 is not applied to the lateral-direction end 30, but is applied to the inner surface 9*a*. Accordingly, a force to tear the transfer belt 9 from the end is not applied, and therefore it is possible to improve the durability of the transfer belt 9.

(Second Embodiment)

Figure 6:
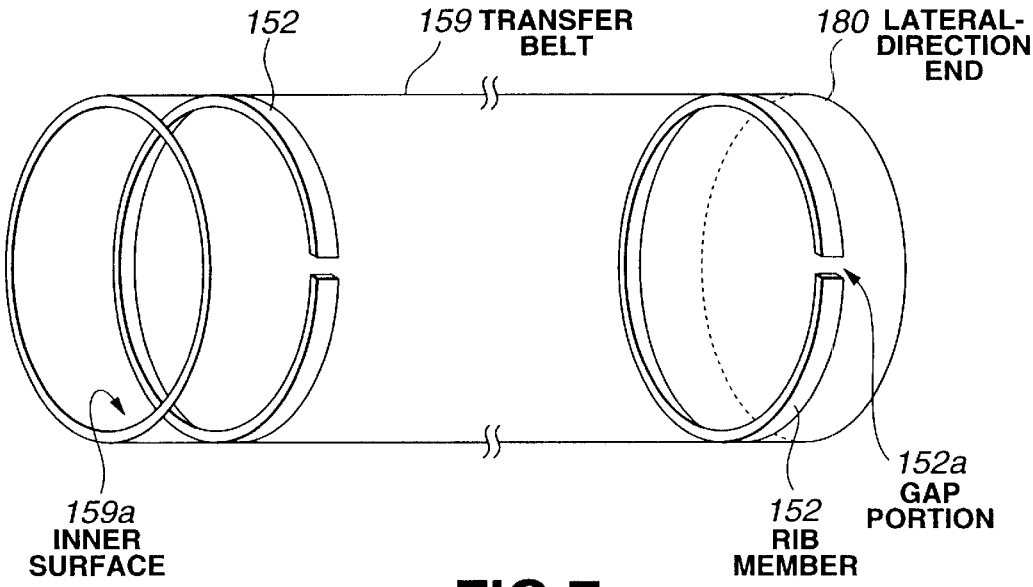
FIG. 6 is a see-through perspective view illustrating a transfer belt according to a second embodiment of the present invention.

FIG. 6 is a see-through perspective view of a transfer belt according to a second embodiment of the present invention.

In FIG. 6, two rib members 152 are mounted at both end portions of a transfer belt 159. When mounting the transfer belt 159 around rollers of an image forming apparatus, by stretching the transfer belt 159 so that the inner surface of each of the rib members 152 contacts an end surface of each of the rollers, skew of the transfer belt 159 while being rotatably driven is suppressed. Hence, it is unnecessary to incline the rollers.

In order to bond the two rib members 152 shown in FIG. 6 to the transfer belt 159, rollers 3*a*, 4*a* and 5*a* having grooves 3*a*', 4*a*' and 5*a*' formed at both end portions, respectively, may be used.

Since the configuration of the second embodiment is the same as that of the first embodiment except for the above-described items, detailed description of the second embodiment will be omitted.

As in the first embodiment, in the second embodiment, by causing the rib members 152 to always contact the end surface of the rollers, skew of the transfer belt 9 is suppressed, so that the positional accuracy of the transfer belt 9 is improved and a high-precision image can be obtained. In addition, since concentration of the stress at a gap portion 152*a* of the rib member 152 is not applied to a lateral-direction end 180, but is applied to an inner surface 159*a*, a force to tear the transfer belt 159 from the end is not applied, and therefore it is possible to improve the durability of the transfer belt 159.

Figure 8:
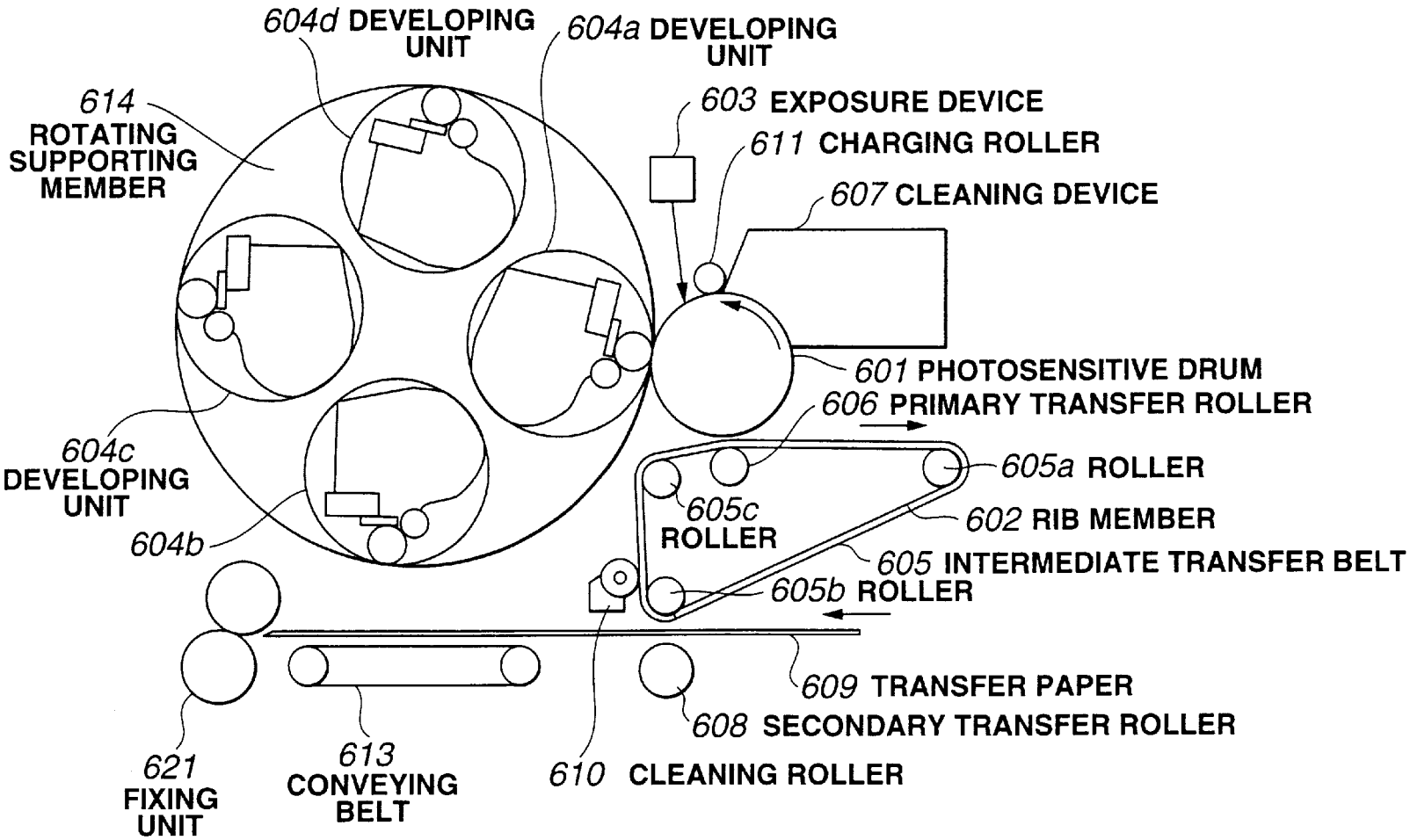
FIG. 8 is a schematic diagram illustrating an image forming apparatus according to a third embodiment of the present invention.

FIG. 8 is a schematic diagram illustrating an image forming apparatus according to a third embodiment of the present invention.

The image forming apparatus of the third embodiment includes a photosensitive drum 601, serving as a first image bearing member. The photosensitive drum 601 is rotatably driven in the direction of the arrow by driving means (not shown). The surface of the photosensitive drum 601 is uniformly charged by a primary charging roller 611 contacting the photosensitive drum 601 while the photosensitive drum 601 rotates. Then, a laser beam L corresponding to a magenta image pattern is projected from an exposure device 603 onto the surface of the photosensitive drum 601, to form an electrostatic latent image on the surface of the photosensitive drum 601.

Four developing units 604*a*, 604*b*, 604*c* and 604*d* are supported on a rotating supporting member 614. By the rotation of the rotating supporting member 614, the developing unit 604*a* accommodating a magenta toner moves to a position facing the photosensitive drum 601 (a developing position), and the latent image on the photosensitive drum 601 is developed by the thus selected developing unit 604*a*. The latent image is visualized by the development as a magenta toner image.

An intermediate transfer belt 605 mounting a rib member 602 is provided as a second image bearing member. The intermediate transfer belt 605 is stretched around rollers 605*a*, 605*b* and 605*c*, is brought in contact with the photosensitive drum 601 by a primary transfer roller 606 provided between the rollers 605*a* and 605*c*, and rotates in the direction of the arrow at a speed substantially the same as the speed of the photosensitive drum 601 by being driven by the roller 605*a*. The rib member 602 for the intermediate transfer belt 605 is mounted at a position such that as in the first embodiment, concentration of the stress at a gap portion (not shown) formed between end surfaces of the rib member 602 is not applied to a lateral-direction end of the intermediate transfer belt 605.

As in the first embodiment, skew of the intermediate transfer belt 605 may be suppressed by causing the rib member 602 to contact, i.e., to be caught by, the end surfaces of the rollers 605*a*, 605*b* and 605*c* by inclining one of the rollers 605*a,* 605*b* and 605*c,* or as in the second embodiment, skew may be suppressed by mounting two rib members 602.

The magenta toner image formed on the photosensitive drum 601 is subjected to primary transfer onto the surface of the intermediate transfer belt 605 by a primary transfer bias voltage applied to the primary transfer roller 606.

By performing the above-described process for each of the other colors, i.e., cyan, yellow and black, a color image obtained by transferring four-color toner images onto the intermediate transfer belt 605 in a superposed state is formed.

Transfer paper 609 is supplied to the intermediate transfer belt 605 at a predetermined timing. At the same time, by applying a secondary transfer bias voltage to a secondary transfer roller 608 in a state in which the secondary transfer roller 608 contacts the intermediate transfer belt 605 via the transfer paper 609, the color toner image on the intermediate transfer belt 605 is subjected to secondary transfer onto the surface of the transfer paper 609 at a time.

The transfer paper 609 having the color toner image transferred thereto is conveyed to a fixing device 621 by a conveying belt 613. The color toner image is fused and fixed on the transfer paper 609 by being heated and pressed at the fixing device 621, to provide a full-color fixed image. Then, the transfer paper 609 is discharged onto a discharged-sheet tray provided outside of the main body of the image forming apparatus. The fixing device 621 may include a fixing roller.

Upon completion of the transfer of the color toner image, toner particles remaining on the surface of the intermediate transfer belt 605 after the secondary transfer are cleaned by a cleaning roller 610. Toner particles remaining on the photosensitive drum 601 after the primary transfer are cleaned by a known cleaning device 607 including blade means.

As in the first and second embodiments, in the third embodiment, skew of the intermediate transfer belt 605 is suppressed by the rib member 602, so that the positional accuracy of the transfer belt 605 is improved and a high-precision image can be obtained. In addition, since concentration of the stress at a gap portion of the rib member 602 is not applied to a lateral-direction end, but is applied to an inner surface of the intermediate transfer belt 605, a force to tear the intermediate transfer belt 605 from the end is not applied, and therefore it is possible to improve the durability of the intermediate transfer belt 605.

Figure 9A:
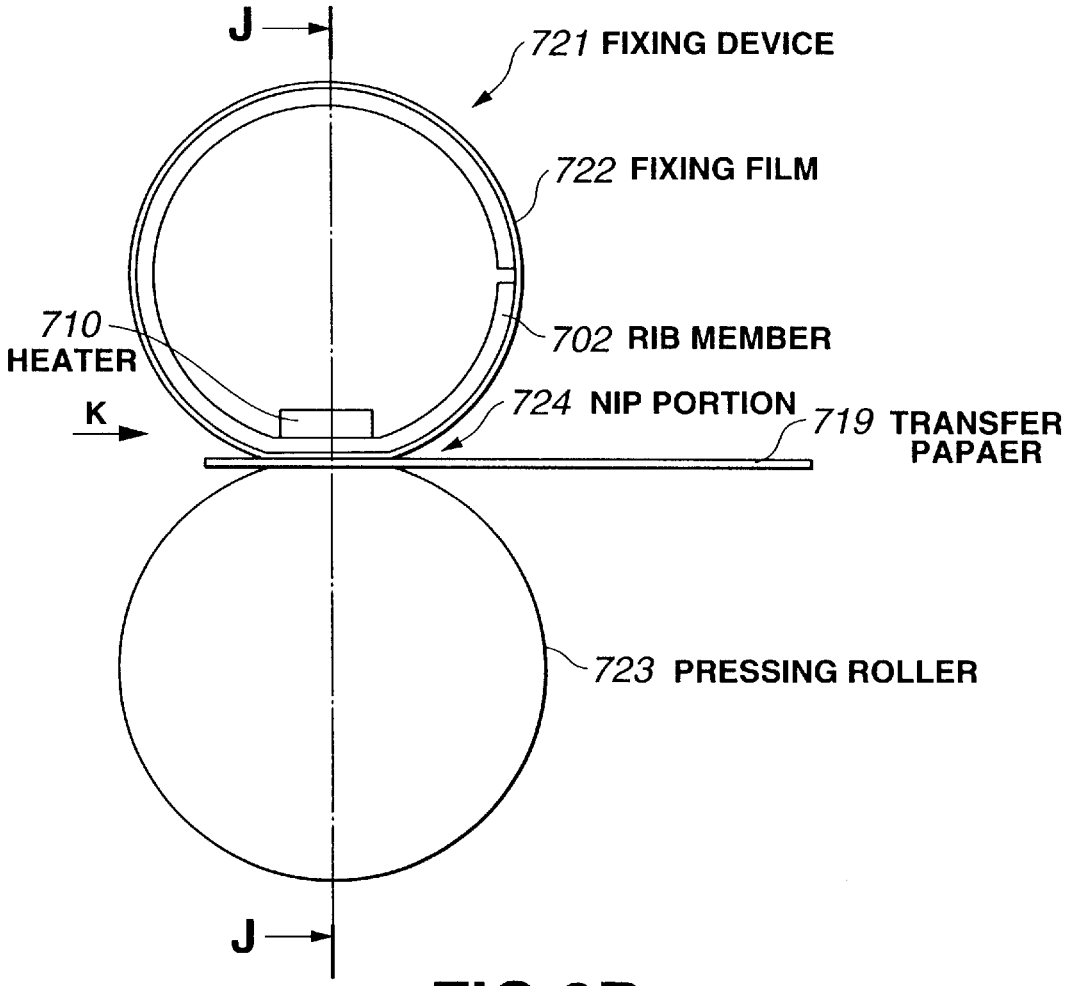
FIGS. 9A and 9B are schematic diagrams of a fixing device in an image forming apparatus according to a fourth embodiment of the present invention.
Figure 9B:
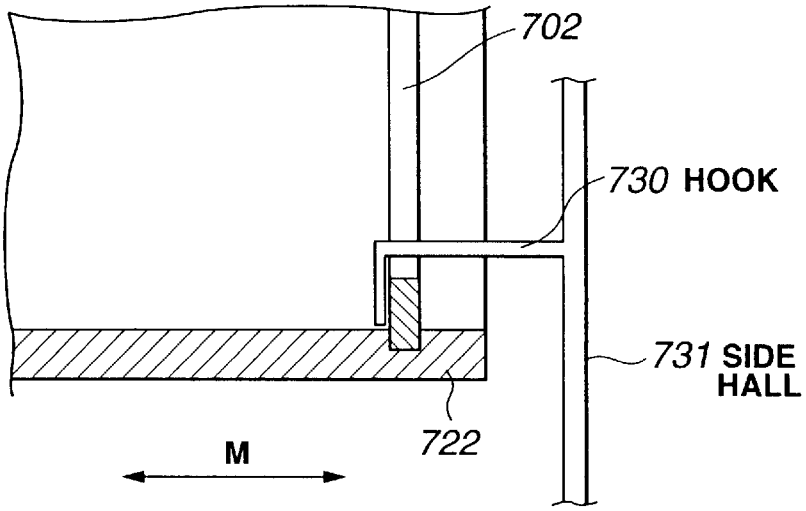

FIG. 9A is a schematic side view of a fixing device in an image forming apparatus according to a fourth embodiment of the present invention. FIG. 9B is a partially enlarged cross-sectional view of a fixing film, taken along line J—J shown in FIG. 9A. In FIG. 9B, a heater is omitted.

A rib member 702 is mounted on the inner circumference of a fixing film 722 comprising a tubular film. A hook 730 extending from a side wall 731 of the image forming apparatus is caused to contact, i.e., to be caught by, the inner side surface of the rib member 702, whereby movement of the fixing film 722 in the direction of an arrow M shown in FIG. 9B is regulated, i.e., skew of the fixing film 722 is suppressed. Transfer paper 719 bearing an unfixed toner image is grasped and conveyed by a nip portion 724 formed by the fixing film 722 and a pressing roller 723 together with the fixing film 722, and the unfixed toner image is fixed on the surface of the transfer paper 719 by heat from a heater 710 supplied via the fixing film 722 and the pressing force of the nip portion 724 as a permanent image.

Since the mounting position of the rib member 702 relative to the fixing film 722, and the shape, the material and the like of the rib member 702 are the same as in the first through third embodiments, a detailed description thereof will be omitted. Since the basic configuration of the image forming apparatus of the fourth embodiment is basically the same as that of the image forming apparatus according to the first or second embodiment, a detailed description thereof will also be omitted.

As in the first through third embodiments, in the fourth embodiment, skew of the fixing film 722 is suppressed by the rib member 202, and concentration of the stress at a gap portion of the rib member 702 is not applied to a lateral-direction end, but is applied to an inner surface of the fixing film 722. Accordingly, a force to tear the fixing film 722 from the end is not applied, and therefore it is possible to improve the durability of the fixing film 722.

The above-described embodiments may be used by being combined.

Examples of endless belts according to the present invention using the image forming apparatus shown in FIG. 1 will now be described. However, the present invention is not limited to the following examples.

EXAMPLE 1

Figure 10:
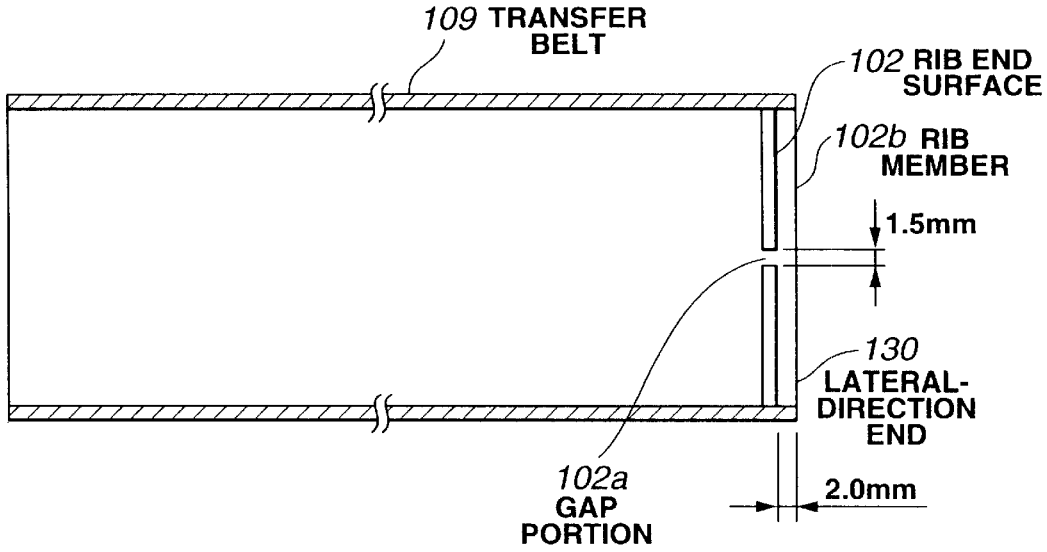
FIG. 10 is a longitudinal cross-sectional view illustrating the dimensions of each portion of a transfer belt used in Examiner 1 of the present invention.

FIG. 10 is a longitudinal cross-sectional view illustrating a transfer belt 109 used in Example 1 of the present invention. In the transfer belt 109 shown in FIG. 10, the groove 9*b* shown in FIG. 3 is not provided. In Example 1, the transfer belt 109 configured as shown in FIG. 10 was used in the image forming apparatus shown in FIG. 1, and the lifetime of the transfer belt was measured.

The transfer belt 109 is 150 $\mu$m thick, and is made of a non-thermoplastic polyimide resin (trade name: Eupilex S, made by Ube Industries. Ltd.) . The volume resistivity of the transfer belt 109 is controlled to $10\times10^{11}$ $\Omega\cdot$cm by adding conductive carbon black particles.

A rib member 102 is mounted to one end portion of the transfer belt 109 at a position such that the distance between a lateral-direction end 130 of the transfer belt 109 and a rib end surface 102 is 2.0 mm. The interval of a gap portion 102*a* of the rib member 102 is 1.5 mm. The cross section of the rib member 102 is a rectangle having dimensions of 4.0×1.5 mm. A side corresponding to the longer side of the cross section of the rib member 102 was bonded to the transfer belt 109. An elastic epoxy adhesive (trade name: EP-001, made by Cemedine Co., Ltd.) having a JIS (Japanese Industrial Standards) A hardness of 80 degrees was used for bonding the rib member 102. As described in Japanese Patent Publication No. 02862317, the use of an adhesive having a JIS A hardness equal to or less than 100 degrees is preferable in consideration of the driving of the belt. The rib member 102 is made of an EPDM (ethylene propylene diene monomer) rubber having a JIS A hardness of 85 degrees which is not conductive.

The transfer belt 109 provided in the above-described manner was mounted around the rollers 15, 16, 17 and 18 of a laser-beam printer (trade name: LBP 2360, made by Canon Inc.), serving as the image forming apparatus 1 shown in FIG. 1, and a durability test of the transfer belt 109 was performed. At that time, the roller 16 was mounted in the image forming apparatus 1 in an inclined state.

Since the positional accuracy of the rib member 102 mounted on the transfer belt 109 of Example 1 was very high and uniform, high precision images were obtained. In addition, since concentration of the stress of the gap portion 102*a* of the rib member 102 was applied to the inner surface of the transfer belt 109, a high end-tear resistance (to be described later) was provided, and tear or the like of the transfer belt 109 did not occur for at least 300 hours.

EXAMPLE 2

Figure 11:
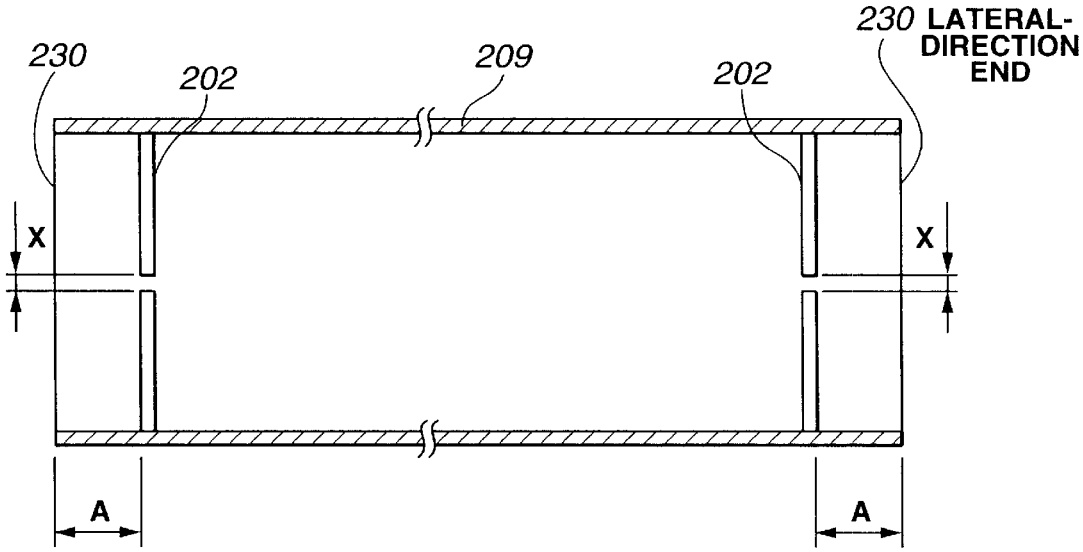
FIG. 11 is a longitudinal cross-sectional view of a transfer belt used in Example 2 of the present invention.
Figure 12:
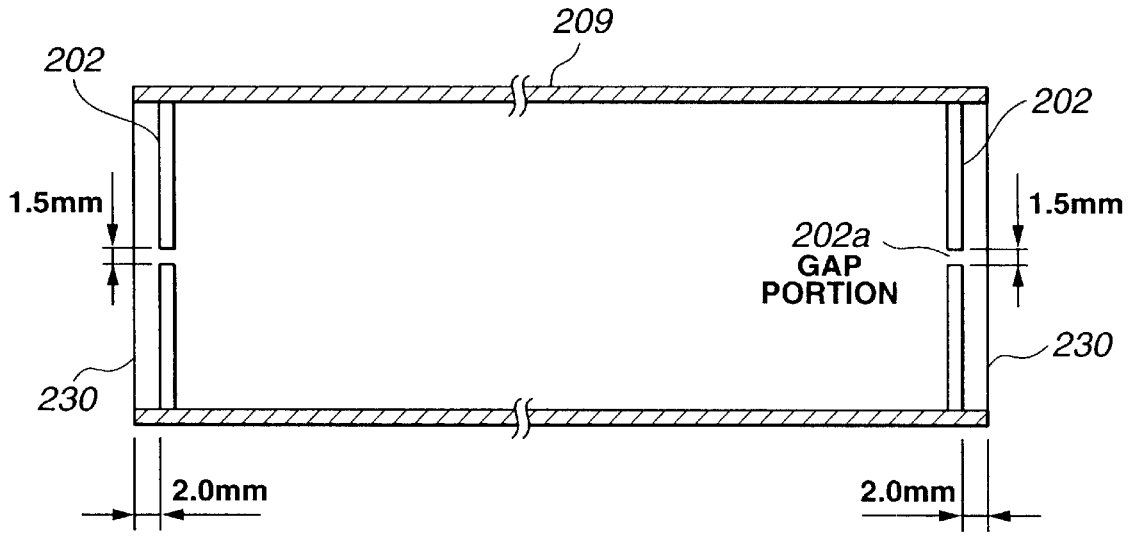
FIG. 12 is a longitudinal cross-sectional view illustrating the dimensions of each portion of a transfer belt shown in FIG. 11.

FIGS. 11 and 12 illustrate a transfer belt 209 used in Example 2 of the present invention. FIG. 11 is a longitudinal cross-sectional view of the transfer belt 209. FIG. 12 is a longitudinal cross-sectional view illustrating the mounting positions of rib members 202 on the transfer belt 209.

In Example 2, the rib members 202 are mounted at both end portions of the transfer belt 209. A distance A from a lateral-direction end 230 of the transfer belt 209 to an end surface of each of the rib members 202 is 2.0 mm, and a distance X of a gap portion 202*a* is 1.5 mm. These distances A and X are the same for both of the rib members 202.

The thickness and the volume resistivity of the transfer belt 209 are the same as in Example 1, i.e., 150 $\mu$m and $10\times10^{11}$ Ω·cm, but polyvinylidene fluoride resin (trade name: KF Polymer, made by Kureha Chemical Industry Co., Ltd.) is used as the material for the transfer belt 209.

Figure 7:
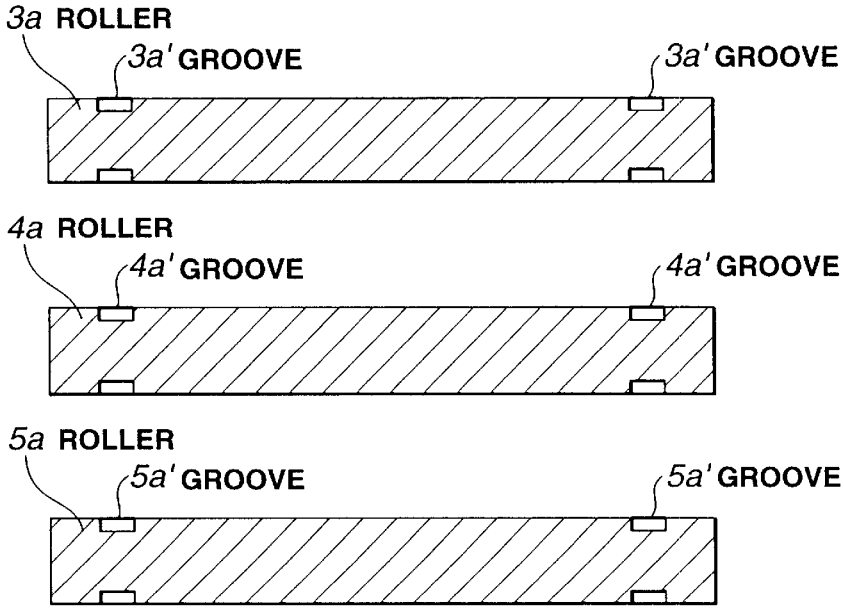
FIG. 7 represents cross-sectional views of rollers in each of which two grooves for bonding two rib members to the transfer belt are formed.

The dimension of the rib member 202, the material of the adhesive, and the method for mounting the rib member 202 on the transfer belt 209 are the same as in Example 1. The types shown in FIG. 7 are used for the rollers used when mounting the rib member 202 on the transfer belt 209.

The above-described transfer belt 209 was stretched around the rollers 15, 16, 17 and 18 of the image forming apparatus used in Example 1 which basically has the same configuration as that of Example 2 except that the roller 16 was not inclined, and a durability test of the transfer belt 209 was performed. In Example 2, also, high-precision images were obtained, and tear or the like of the transfer belt 209 did not occur for at least 300 hours.

EXAMPLE 3

Figure 13:
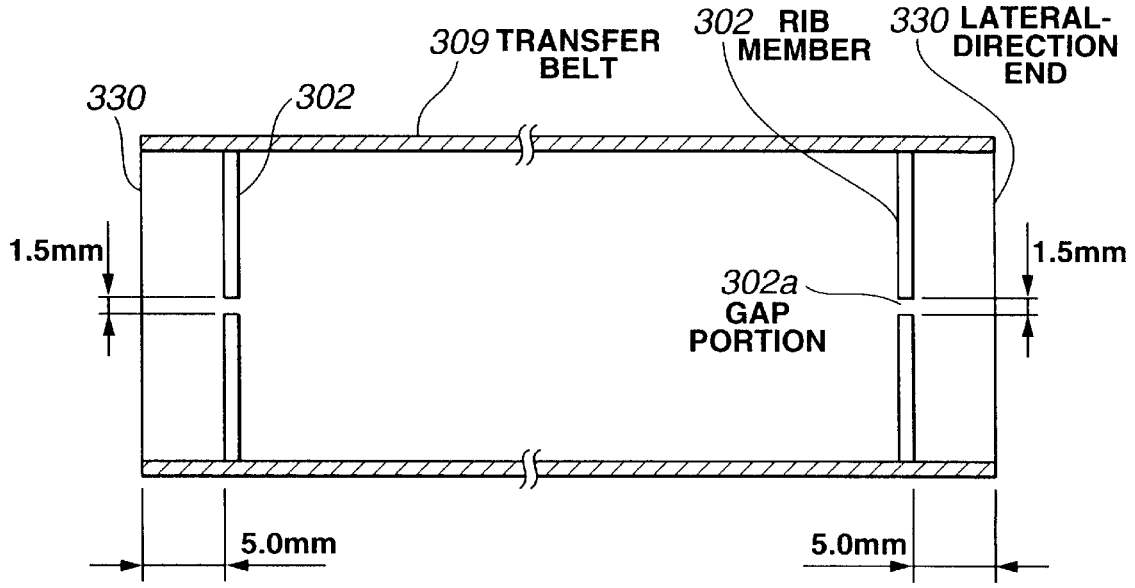
FIG. 13 is a longitudinal cross-sectional view illustrating the dimensions of each portion of a transfer belt used in Examiner 3 of the present invention.

FIG. 13 is a longitudinal cross-sectional view illustrating a transfer belt 309 used in Example 3 of the present invention.

As in Example 2, in Example 3, two rib members 302 are mounted on the transfer belt 309. However, the distance from a lateral-direction end 330 of the transfer belt 309 to an end surface of the rib member 302 is 5.0 mm, in contrast to 2.0 mm in Example 2, i.e., the rib members 302 are mounted at portions more inner than in Example 2. The dimensions of the rib members 302, the distance of a gap portion 302*a,* the material of the adhesive used, and the method of mounting the rib members 302 on the transfer belt 309 are the same as in Examples 1 and 2.

The above-described transfer belt 309 was stretched around the rollers of the image forming apparatus used in Example 2 in which the roller 16 was not inclined, and a durability test of the transfer belt 309 was performed. In Example 3, also, high-precision images were obtained, and tear or the like of the transfer belt 309 did not occur for at least 700 hours.

Comparative Example

Figure 14:
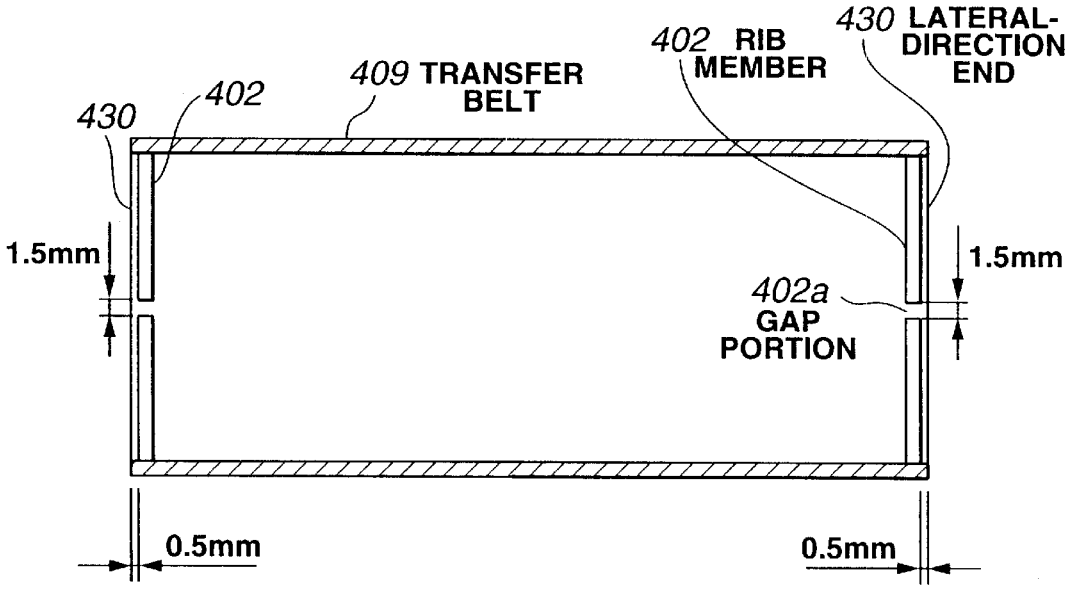
FIG. 14 is a longitudinal cross-sectional view illustrating the dimensions of each portion of a transfer belt used for the purpose of comparisons.

FIG. 14 is a longitudinal cross-sectional view illustrating a transfer belt 409 for comparison with Examples 1–3.

The configuration of Comparative Example is the same as in Examples 2 and 3, except that the distance from a lateral-direction end 430 of the transfer 409 to an end surface of each rib member 402 is 0.5 mm. Hence, a detailed description thereof will be omitted.

The above-described transfer belt 409 was stretched around the rollers of the image forming apparatus used in Examples 2 and 3 in which the roller 16 was not inclined, and a durability test of the transfer belt 409 was performed. In Comparative Example, a crack generated from a gap portion 402*a* of the rib member 402 of the transfer belt 409 was confirmed at 50 hours.

EXAMPLE 4

A transfer belt was manufactured in the same manner as in Example 2, except that the first distance (A) and the second distance (X) were set to 3.0 mm and 1.5 mm, respectively. A durability test was performed, and durability of at least 500 hours was confirmed.

EXAMPLE 5

A transfer belt was manufactured in the same manner as in Example 2, except that the first distance (A) and the second distance (X) were set to 3.0 mm and 1 mm, respectively. A durability test was performed, and durability of at least 700 hours was confirmed.

EXAMPLE 6

A transfer belt was manufactured in the same manner as in Example 2, except that the first distance (A) and the second distance (X) were set to 1.6 mm and 1.5 mm, respectively. A durability test was performed, and durability of at least 100 hours was confirmed.

Table 1 illustrates conditions and results of measurements of the above-described Example 1–3 and Comparative Example.

TABLE 1

| | | Rib member | | Adhesive | |
|---|---|---|---|---|---|
| | Belt material | Material | Hardness (JIS A hardness) | Material | Hardness (JIS A hardness) |
| Example 1 | PI | EPDM | 85 | Elastic epoxy type | 80 |
| Example 2 | PVdF | EPDM | 85 | Elastic epoxy type | 80 |
| Example 3 | PVdF | EPDM | 85 | Elastic epoxy type | 80 |
| Comparative Example | PVdF | EPDM | 85 | Elastic epoxy type | 80 |
| Example 4 | PVdF | EPDM | 85 | Elastic epoxy type | 80 |
| Example 5 | PVdF | EPDM | 85 | Elastic epoxy type | 80 |
| Example 6 | PVdF | EPDM | 85 | Elastic epoxy type | 80 |

| | X | A | Rib position | Lifetime |
|---|---|---|---|---|
| Example 1 | 1.5 | 2.0 | One end | At least 300 H |
| Example 2 | 1.5 | 2.0 | Both ends | At least 300 H |
| Example 3 | 1.5 | 5.0 | Both ends | At least 700 H |
| Comparative Example | 1.5 | 0.5 | Both ends | 50 |
| Example 4 | 1.5 | 3.0 | Both ends | At least 500 H |
| Example 5 | 1 | 3.0 | Both ends | At least 700 H |
| Example 6 | 1.5 | 1.6 | Both ends | At least 100 H |

The lifetime was evaluated using ten transfer belts for each example, and the earliest time in which a crack was generated was adopted as the lower limit value.

The reasons why the durability is improved by mounting the rib members at positions more or less separated from end surfaces of the transfer bent in the above-described manner will now be considered.

Table 2 illustrates results of measurements of end-tear resistance strength (a strength for starting tear) and a tear strength (a strength required for transmitting tear) of polyvinylidene fluoride resin.

TABLE 2

| | |
|---|---|
| End-tear resistance strength (method C: orthogonal tear strength) | 7350–8232 mN |
| Tear strength (method A: Trouser tear strength) | 1470–1960 mN |

The method of measurement conforms to the JIS K7128 method, and method C (orthogonal tear strength) and method A (Trouser tear strength) were used as the end-tear resistance strength and the tear strength, respectively.

Table 2 indicates that the end-tear resistance strength is 4–5 times the tear strength.

That is, when bonding the rib members 402 at positions very close to the lateral-direction ends 430 of the transfer belt 409 as in Comparative Example, concentration of the stress of the gap portion of the rib member 402 is applied to the lateral-direction ends 430 of the transfer belt 409. Even if the lateral-direction ends 430 are formed by cutting the transfer belt 409 using a very sharp cutter, cut surfaces are estimated to be more or less rough microscopically. That is, the behavior of the transfer belt 409 when mounting the rib members 402 at positions very close to the lateral-direction ends 430 is estimated to be similar to tear of the transfer belt 409. Accordingly, it can be considered that the transfer belt 409 was broken by concentration of a small stress at the gap portion 402*a* of the rib member 402.

The behavior of the transfer belt when mounting the rib members at positions separated from the lateral-direction ends of the transfer belt as in Examples 1–6 is similar to the behavior when tearing the continuous surface of the transfer belt, i.e., an end-tear-resistance-like behavior. Accordingly, it can be considered that a failure such as a tear or the like will hardly occur even if a stress is applied to the transfer belt.

The individual components shown in outline in the drawings are all well known in the endless belt, conveying device, tubular film and image forming apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A transfer belt, comprising:

an endless belt having an inner surface and lateral ends, said endless belt adapted to being stretched between at least two rollers;

at least one rib member provided on said inner surface of said endless belt and disposed in a circumferential direction, said rib member having opposite ends facing each other and providing a gap therebetween, wherein a first distance, defined between said rib member and a lateral end of said endless belt closest to said rib member, is greater than a second distance, defined by the gap between the opposite ends of said rib member.

2. A belt according to claim 1, wherein the first distance is greater than the second distance by at least twice.

3. A belt according to claim 1, wherein the second distance is 1–5 mm.

4. A belt according to claim 1, wherein a cross-section of said at least one rib member is rectangular.

5. A belt according to claim 1, wherein a hardness of said at least one rib member is smaller than a hardness of said endless belt.

6. A belt according to claim 1, wherein two rib members are provided on said inner surface of said endless belt.

7. A method for manufacturing an endless belt having at least one rib member on its inner circumferential surface, said method comprising the steps of:

forming a circumferential groove on an inner surface of the endless belt, the groove being formed at a first distance from a lateral end of the endless belt closest to the groove;

mounting the rib member in the groove and providing a gap portion between opposite ends of the rib member facing each other, with a second distance defined by the gap portion; and providing that the first distance is greater than the second distance.

8. A method according to claim 7, wherein the first distance is greater than the second distance by at least twice.

9. A method according to claim 7, further comprising the step of forming a cross-section of the at least one rib member to be rectangular.

10. A method according to claim 7, further comprising the step of forming the at least one rib member with a material whose hardness is smaller than a hardness of the endless belt.

11. A method according to claim 7, further comprising the step of providing two rib members on the inner surface of the endless belt.

12. A conveying device comprising:

a conveying belt;

at least two rollers, with said conveying belt stretched between said rollers; and driving means for driving at least one of said rollers, said conveying device conveying a sheet material mounted on said conveying belt, wherein said conveying belt is comprised of:

an endless belt having an inner surface and lateral ends;

at least one rib member provided on said inner surface of said endless belt disposed in a circumferential direction, said rib member having opposite ends facing each other and providing a gap therebetween, wherein a first distance, defined between said rib member and a lateral end of said endless belt closest to said rib member, is greater than a second distance, defined by the gap between the opposite ends of said rib member.

13. A conveying device according to claim 12, wherein the first distance is longer than the second distance by at least twice.

14. A conveying device according to claim 12, wherein the second distance is 1–5 mm.

15. A conveying device according to claim 12, wherein a cross-section of said at least one rib member is rectangular.

16. A conveying device according to claim 12, wherein a hardness of said at least one rib member is smaller than a hardness of said endless belt.

17. A tubular film regulating assembly, comprising:

an endless belt having an inner surface and lateral ends, said endless belt adapted to being stretched between at least two rollers;

at least one rib member provided on said inner surface of said endless belt and disposed in a circumferential direction, said rib member having opposite ends facing each other and providing a gap therebetween, wherein a first distance, defined between said rib member and a lateral end of said endless belt closest to said rib member, is greater than a second distance, defined by the gap between the opposite ends of said rib member; and an external regulating member extending toward said inner surface of said endless belt, with said regulating member contacting said rib member when said endless belt is rotatively driven.

18. A tubular film regulating assembly according to claim 17, wherein the first distance is greater than the second distance by at least twice.

19. A tubular film regulating assembly according to claim 17, wherein a cross-section of said at least one rib member is rectangular.

20. A tubular film regulating assembly according to claim 17, wherein a hardness of said at least one rib member is smaller than a hardness of said tubular film.

21. A tubular film regulating assembly according to claim 17, wherein two rib members are provided on said inner surface of said endless belt.

22. A method for manufacturing a tubular film regulating assembly, comprising the steps of:

forming a circumferential groove on an inner surface of an endless belt, the groove being formed at a first distance from a lateral end of the endless belt closest to the groove;

mounting a rib member in the groove and providing a gap portion between opposite ends of the rib member facing each other, with a second distance defined by the gap portion;

providing that the first distance is greater than the second distance;

extending an external regulating member toward the inner surface of the endless belt; and contacting the rib member with the regulating member as the endless belt is rotated.

23. A method according to claim 22, wherein the first distance is greater than the second distance by at least twice.

24. A method according to claim 22, further comprising the step of forming a cross-section of the rib member to be rectangular.

25. A method according to claim 22, further comprising the step of forming the rib member with a material whose hardness is smaller than a hardness of the endless belt.

26. A method according to claim 22, further comprising the step of providing two rib members on the inner surface of the endless belt.

27. An electrophotographic image forming apparatus comprising:

a conveying belt;

image forming means, including a photosensitive drum, for forming an image; and a fixing device, wherein a latent image is formed on a surface of a charged photosensitive drum by scanning its surface with a laser beam, a toner is caused to adhere to the latent image, the toner is then transferred onto a recording material on said conveying belt, and the toner is fixed by said fixing device, and wherein said conveying belt is an endless belt having an inner surface and lateral ends, said endless belt adapted to being stretched between at least two rollers;

at least one rib member provided on said inner surface of said endless belt disposed in a circumferential direction, said rib member having opposite ends facing each other and providing a gap therebetween, wherein a first distance, defined between said rib member and a lateral end of said endless belt closest to said rib member, is greater than a second distance, defined by the gap between the opposite ends of said rib member.

28. An apparatus according to claim 27, further comprising an intermediate belt for performing, after primary transfer of the toner adhered to said photosensitive drum, secondary transfer of the toner subjected to the primary transfer onto the recording material, wherein said intermediate belt is a second endless belt having an inner surface and lateral ends, said second belt adapted to being stretched between at least two rollers;

at least one rib member provided on said inner surface of said second endless belt disposed in a circumferential direction, said rib member having opposite ends facing each other and providing a gap therebetween, wherein a first distance, defined between said rib member and a lateral end of said second endless belt closest to said rib member, is greater than a second distance, defined by the gap between the opposite ends of said rib member.

29. An apparatus according to claim 28, wherein the first distance is longer than the second distance by at least twice.

30. An apparatus according to claim 28, wherein the second distance is 1–5 mm.

31. An apparatus according to claim 28, wherein a cross-section of said at least one rib member is rectangular.

32. An apparatus according to claim 28, wherein a hardness of said at least one rib member is smaller than a hardness of said endless belt.

33. An apparatus according to claim 27, wherein said fixing device comprises a pressing roller; and a tubular film regulating assembly that includes a second endless belt having an inner surface and lateral ends, said second endless belt adapted to being stretched between at least two rollers;

at least one rib member provided on said inner surface of said second endless belt disposed in a circumferential direction, said rib member having opposite ends facing each other and providing a gap therebetween, wherein a first distance, defined between said rib member and a lateral end of said endless belt closest to said rib member, is greater than a second distance, defined by the gap between the opposite ends of said rib member; and an external regulating member extending toward said inner surface of said endless belt, with said regulating member contacting said rib member when said second endless belt is rotatively driven.

34. An apparatus according to claim 33, wherein the first distance is longer than the second distance by at least twice.

35. An apparatus according to claim 33, wherein a cross-section of said at least one rib member is rectangular.

36. An apparatus according to claim 33, wherein a hardness of said at least one rib member is smaller than a hardness of said tubular film.

37. An apparatus according to claim 27, wherein the first distance is longer than the second distance by at least twice.

38. An apparatus according to claim 27, wherein the second distance is 1–5 mm.

39. An apparatus according to claim 27, wherein a cross-section of said at least one rib member is rectangular.

40. An apparatus according to claim 27, wherein a hardness of said at least one rib member is smaller than a hardness of said endless belt.

41. An apparatus according to claim 27, wherein two rib members are provided on said inner surface of said endless belt.

* * * * *

UNITED STATES PATENT AND TRADEMARK OFFICE

CERTIFICATE OF CORRECTION

PATENT NO. : 6,453,143 B2
DATED : September 17, 2002
INVENTOR(S) : Kazutaka Takeuchi It is certified that error appears in the above-identified patent and that said Letters Patent is hereby corrected as shown below:

Column 5,
Line 61, “Examiner 1” should read -- Example 1 --.

Column 6,
Line 3, “Examiner 3” should read -- Example 3 --.

Column 7,
Line 30, “angle a” should read -- angle α --.

Column 8,
Line 26, “3', 4'” should read -- 3', 4' and 5 --.

Column 9,
Line 46, “9 s” should read -- 9 is --.

Column 10,
Line 26, “FIG. 8” should read -- (Third Embodiment)
¶ FIG. 8 --.

Column 11,
Line 47, “FIG. 9A” should read -- (Fourth Embodiment)
¶ FIG. 9A --.

Signed and Sealed this

Twenty-ninth Day of July, 2003

JAMES E. ROGAN
*Director of the United States Patent and Trademark Office*